US011445317B2

(12) United States Patent
Lee et al.

(10) Patent No.: US 11,445,317 B2
(45) Date of Patent: Sep. 13, 2022

(54) METHOD AND APPARATUS FOR LOCALIZING MULTICHANNEL SOUND SIGNAL

(71) Applicants: SAMSUNG ELECTRONICS CO., LTD., Suwon-si (KR); KOREA ADVANCED INSTITUTE OF SCIENCE AND TECHNOLOGY, Daejeon (KR)

(72) Inventors: Yoon-jae Lee, Seoul (KR); Young-jin Park, Daejeon (KR); Hyun Jo, Daejeon (KR); Sun-min Kim, Yongin-si (KR); Young-tae Kim, Seongnam-si (KR)

(73) Assignees: SAMSUNG ELECTRONICS CO., LTD., Suwon-si (KR); KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 692 days.

(21) Appl. No.: 14/324,740

(22) Filed: Jul. 7, 2014

(65) Prior Publication Data

US 2014/0334626 A1 Nov. 13, 2014

Related U.S. Application Data

(63) Continuation of application No. PCT/KR2013/000047, filed on Jan. 4, 2013.

(Continued)

(51) Int. Cl.

*H04S 5/00* (2006.01)
*H04S 7/00* (2006.01)

(52) U.S. Cl.

CPC ..... *H04S 5/00* (2013.01); *H04S 7/307* (2013.01); *H04S 2400/11* (2013.01); *H04S 2420/01* (2013.01); *H04S 2420/07* (2013.01)

(58) Field of Classification Search

CPC .... H04S 5/00; H04S 2420/01; H04S 2420/07; H04S 2400/11; H04S 7/307; H04S 7/307

(Continued)

(56) References Cited

U.S. PATENT DOCUMENTS 6,307,941 B1 * 10/2001 Tanner, Jr. ..... H04S 1/002 381/1
6,504,933 B1 * 1/2003 Chung ..... H04S 1/002 381/1

(Continued)

FOREIGN PATENT DOCUMENTS

EP 1 058 481 B1 12/2008
JP 2001-16697 A 1/2001

(Continued)

OTHER PUBLICATIONS

Algazi, V.R., et al. "The CIPIC HRTF Database", Oct. 24, 2001, IEEE, Proceedings of the 2001 IEEE Workshop on the Applications of Signal Processing to Audio and Acoustics, pp. 99-102. (Year: 2001).*

(Continued)

*Primary Examiner* — Daniel R Sellers
(74) *Attorney, Agent, or Firm* — Sughrue Mion, PLLC

(57) ABSTRACT

Provided are a method and apparatus for localizing a multichannel sound signal. The method includes: obtaining a multichannel sound signal to which sense of elevation is applied by applying a first filter to an input sound signal; determining at least one frequency range of a dynamic cue according to change of a head-related transfer function (HRTF) indicating information regarding paths from a spatial location of an actual speaker to ears of an audience; and applying a second filter to at least one sound signal, corresponding to the determined at least one frequency range, of at least one channel in the multichannel sound signal to change the at least one sound signal so as to remove or to (Continued)

reduce the dynamic cue when the multichannel sound signal is output.

11 Claims, 5 Drawing Sheets

Related U.S. Application Data

(60) Provisional application No. 61/583,309, filed on Jan. 5, 2012.

(58) Field of Classification Search
USPC ..... 381/17
See application file for complete search history.

(56) References Cited

U.S. PATENT DOCUMENTS

| | | | | |
|---|---|---|---|---|
| 6,504,934 | B1 * | 1/2003 | Kasai | H04S 1/007 381/1 |
| 7,231,054 | B1 * | 6/2007 | Jot | H04S 3/00 381/18 |
| 7,801,317 | B2 | 9/2010 | Kim | |
| 8,295,493 | B2 | 10/2012 | Faller | |
| 8,705,779 | B2 | 4/2014 | Lee et al. | |
| 2005/0053249 | A1 * | 3/2005 | Wu | H04S 5/005 381/310 |
| 2007/0061026 | A1 | 3/2007 | Wang | |
| 2007/0092085 | A1 | 4/2007 | Katayama et al. | |
| 2008/0253577 | A1 * | 10/2008 | Eppolito | H04S 7/40 381/17 |
| 2009/0034772 | A1 | 2/2009 | Iida et al. | |
| 2010/0027819 | A1 * | 2/2010 | Van Den Berghe | G10L 19/008 381/302 |
| 2010/0266133 | A1 | 10/2010 | Nakano | |
| 2011/0164755 | A1 * | 7/2011 | Chabanne | H04R 5/04 381/17 |
| 2011/0222693 | A1 * | 9/2011 | Lee | H03G 9/005 381/17 |
| 2011/0264456 | A1 | 10/2011 | Koppens et al. | |
| 2012/0008789 | A1 * | 1/2012 | Kim | H04S 3/002 381/17 |
| 2014/0064493 | A1 | 3/2014 | Kim | |

FOREIGN PATENT DOCUMENTS

| | | | |
|---|---|---|---|
| JP | 2010-258497 | A | 11/2010 |
| KR | 10-2005-0115801 | A | 12/2005 |
| KR | 10-2007-0066820 | A | 6/2007 |
| KR | 10-2008-0042160 | A | 5/2008 |
| KR | 10-2010-0077424 | A | 7/2010 |
| KR | 10-0971700 | B1 | 7/2010 |
| KR | 10-2012-0004909 | A | 1/2012 |

OTHER PUBLICATIONS

Pulkki, Ville, "Virtual Sound Source Positioning Using Vector Base Amplitude Panning", Jun. 1997, Journal of the Audio Engineering Society, vol. 45, No. 6, pp. 456-466. (Year: 1997).*

Kim et al., "Virtual Ceiling Speaker: Elevating auditory imagery in a 5-channel reproduction", Oct. 12, 2009, Audio Engineering Society, AES 127th Convention, Convention Paper 7886, pp. 1-12. (Year: 2009).*

Lee et al., "Virtual Height Speaker Rendering for Samsung 10.2-channel Vertical Surround System", Oct. 23, 2011, Audio Engineering Society, AES 131st Convention, Convention Paper 8523, pp. 1-10. (Year: 2011).*

Translation of Written Opinion dated Apr. 30, 2013 issued by the International Authority in counterpart Application No. PCT/KR2013/000047 (PCT/ISA/237).

Illenyi, A., et al., "Evaluation of HRTF Data using the Head-Related Transfer Function Differences", Forum Acusticum, Dec. 31, 2005, Budapest, Hungary, 6 pages total, XP055223415.

Communication dated Nov. 25, 2015, issued by the European Patent Office in counterpart European Patent Application No. 13733650.9.

Communication dated Mar. 21, 2019, issued by the Korean Intellectual Property Office in counterpart Korean Patent Application No. 10-2013-0001218.

* cited by examiner

METHOD AND APPARATUS FOR LOCALIZING MULTICHANNEL SOUND SIGNAL

CROSS-REFERENCE TO RELATED PATENT APPLICATIONS

This application is a continuation of PCT/KR2013/000047, filed on Jan. 4, 2013, which claims the benefit of U.S. Provisional Application No. 61/583,309, filed on Jan. 5, 2012 in the U.S. Patent and Trademark Office, the disclosures of which are incorporated herein in their entirety by reference.

BACKGROUND

1. Field

Apparatuses and methods consistent with exemplary embodiments relate to localizing a multichannel sound signal, and more particularly, to localizing a multichannel sound signal by applying sense of elevation to the multichannel sound signal.

2. Description of the Related Art

Along with the recent developments in multimedia technologies, research is being actively made on the acquisition and reproduction of high-quality audio and video. Particularly, along with the developments in three-dimensional (3D) stereoscopic imaging technologies, stereoscopic audio technologies are also being focused on.

From among stereoscopic audio technologies, sound image localization is a technique for localizing a virtual sound image at a location, where no actual speaker is located, for a more realistic audio reproduction.

The sound image localization may be categorized into horizontal surface sound image localization and vertical surface sound image localization. Here, the vertical surface sound image localization may not be as efficient as the horizontal surface sound image localization. Therefore, there is a demand for an efficient technique for vertical surface sound image localization to provide realistic sound to an audience.

SUMMARY

Aspects of one or more exemplary embodiments provide a method and an apparatus for localizing a multichannel sound signal, by which an audience receives a realistic sense of elevation from the multichannel sound signal.

According to an aspect of an exemplary embodiment, there is provided a method of localizing a multichannel sound signal, the method including: generating a multichannel sound signal to which sense of elevation is applied by applying a first filter, which corresponds to a predetermined elevation, to an input sound signal; determining at least one frequency range of a dynamic cue according to change of a head-related transfer function (HRTF) indicating information regarding paths from a spatial location of an actual speaker to ears of an audience; and applying a second filter to at least one sound signal, corresponding to the determined at least one frequency range, of at least one channel in the multichannel sound signal to change the at least one sound signal so as to remove or to reduce the dynamic cue when the multichannel sound signal is output.

The generating the multichannel sound signal may include: applying the first filter to an input mono sound signal; and generating the multichannel sound signal to which the sense of elevation is applied by replicating the input mono sound signal to which the first filter is applied.

The first filter may be determined according to: a second HRTF/a first HRTF, wherein the second HRTF includes an HRTF indicating information regarding paths from a spatial location of a virtual speaker located at the predetermined elevation to the ears of the audience, and the first HRTF includes the HRTF indicating information regarding the paths from the spatial location of the actual speaker to the ears of the audience.

The determining the at least one frequency range of the dynamic cue may include determining, as the at least one frequency range of the dynamic cue, at least one frequency range in the frequency domain of the HRTF that changes in correspondence to changes of locations of the ears of the audience or a change of the audience.

The multichannel sound signal may include a stereo sound signal, the second filter may include a phase inverse filter for inversing a phase of at least one sound signal included in the at least one frequency range of the dynamic cue, and wherein the applying the second filter to the at least one sound signal of the at least one channel in the multichannel sound signal may include applying the phase inverse filter to at least one sound signal, in the at least one frequency range, of one channel from among channels of the stereo sound signal.

The second filter may include an amplitude adjusting filter for adjusting amplitudes of at least one signal included in the at least one frequency range of the dynamic cue.

The multichannel sound signal may include a stereo sound signal, the second filter may include a delay filter for delaying at least one sound signal included in the at least one frequency range of the dynamic cue, and wherein the applying the second filter to the at least one sound signal of the at least one channel in the multichannel sound signal includes applying the delay filter to at least one sound signal, in the at least one frequency range, of one channel from among channels of the stereo sound signal.

The method may further include adjusting amplitudes of at least one sound signal of respective channels in the multichannel sound signal, such that the virtual speaker is located on a predetermined position on a horizontal surface including the virtual speaker at the predetermined elevation.

According to an aspect of another exemplary embodiment, there is provided a computer-readable recording medium having recorded thereon a computer program for implementing the method.

According to an aspect of another exemplary embodiment, there is provided a multichannel sound signal localizing apparatus including: a multichannel sound signal obtainer configured to obtain a multichannel sound signal to which sense of elevation is applied by applying a first filter, which corresponds to a predetermined elevation, to an input sound signal; a frequency range determiner configured to determine at least one frequency range of a dynamic cue according to change of a head-related transfer function (HRTF) indicating information regarding paths from a spatial location of an actual speaker to ears of an audience; and a second filterer configured to apply a second filter to at least one sound signal, corresponding to the determined at least one frequency range, of at least one channel in the multichannel sound signal to change the at least one sound signal so as to remove or to reduce the dynamic cue when the multichannel sound signal is output.

The multichannel sound signal obtainer may include: a first filterer configured to apply the first filter to an input mono sound signal; and a signal replicator configured to obtain the multichannel sound signal to which the sense of elevation is applied by replicating the input mono sound signal to which the first filter is applied.

The first filter may be determined according to: a second HRTF/a first HRTF, wherein the second HRTF includes an HRTF indicating information regarding paths from a spatial location of a virtual speaker located at the predetermined elevation to the ears of the audience, and the first HRTF includes the HRTF indicating the information regarding the paths from the spatial location of the actual speaker to the ears of the audience.

The frequency range determiner may determine, as the at least one frequency range, at least one frequency range in the frequency domain of the HRTF that changes in correspondence to changes of locations of the ears of the audience or a change of the audience.

The multichannel sound signal may include a stereo sound signal, the second filter may include a phase inverse filter for inversing a phase of at least one sound signal included in the at least one frequency range of the dynamic cue, and the second filterer may apply the phase inverse filter to at least one sound signal, included in the at least one frequency range, of one channel from among channels of the stereo sound signal.

The second filter may include an amplitude adjusting filter for adjusting amplitudes of at least one sound signal included in the at least one frequency range of the dynamic cue.

The multichannel sound signal may include a stereo sound signal, the second filter may include a delay filter for delaying at least one sound signal included in the at least one frequency range of the dynamic cue, and the second filterer may apply the delay filter to at least one sound signal, in the at least one frequency range, of one channel from among channels of the stereo sound signal.

The multichannel sound signal localizing apparatus may further include an amplitude adjuster configured to adjust amplitudes of at least one sound signal of respective channels in the multichannel sound signal, such that the virtual speaker is located on a predetermined position on a horizontal surface including the virtual speaker at the predetermined elevation.

According to an aspect of another exemplary embodiment, there is provided a method of localizing a multichannel sound signal, the method including: determining at least one frequency range of a dynamic cue according to change of a head-related transfer function (HRTF) indicating information regarding paths from a spatial location of an actual speaker to ears of an audience; and applying a second filter to at least one sound signal, corresponding to the determined at least one frequency range, of at least one channel in a multichannel sound signal to change the at least one sound signal so as to remove or to reduce the dynamic cue when the multichannel sound signal is output.

BRIEF DESCRIPTION OF THE DRAWINGS

The above and other features and advantages will become more apparent by describing in detail exemplary embodiments with reference to the attached drawings in which.

DETAILED DESCRIPTION OF EXEMPLARY EMBODIMENTS

Figure 1:
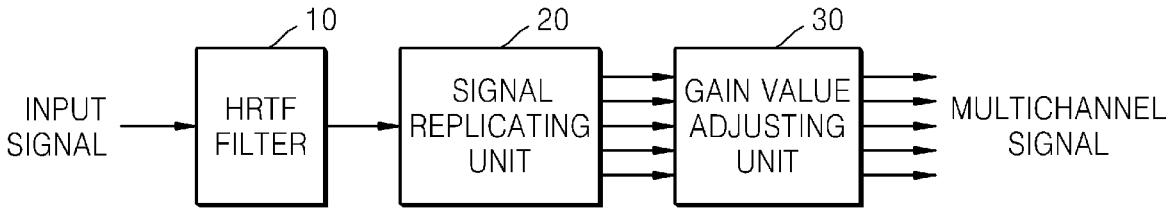
FIG. 1 is a diagram for describing a related art method of localizing a multichannel sound signal.

Exemplary embodiments will now be described more fully with reference to the accompanying drawings. An exemplary embodiment may, however, be embodied in many different forms and should not be construed as being limited to exemplary embodiments set forth herein; rather, these exemplary embodiments are provided so that this disclosure will be thorough and complete, and will fully convey the inventive concept to those skilled in the art. Like reference numerals in the drawings denote like elements.

A term "unit", that is, "module", used in the description of exemplary embodiment means software components or hardware components such as a field-programmable gate array (FPGA) and an application-specific integrated circuit (ASIC). Also, the module is configured to perform predetermined operations. However, the module or unit is not limited to software or hardware. The module can be formed such that the module is stored in an addressable recording media. Also, the module can be formed such that one or more processes are executed. For example, the module may include components, such as software components, object-oriented software components, class components, and task components, processes, functions, attributes, procedures, subroutines, segments of program codes, drivers, firmware, micro-code, circuits, data, databases, data formats, tables, arrays, and variables. Herein, operations provided by the above components and modules can be achieved with a smaller number of components and modules by combining components and modules with each other, or can be achieved with a larger number of components and modules by dividing the components and the modules.

FIG. 1 is a diagram for describing a related art method of localizing a multichannel sound signal in the.

Referring to FIG. 1, a head-related transfer function (HRFT) filter 10 applies sense of elevation corresponding to a predetermined elevation to an input signal. The HRFT filter 10 may make an audience (e.g., one or more listeners) feel that an output sound signal is output by a virtual speaker located at the predetermined elevation, instead of an actual speaker.

A signal replicating unit 20 (e.g., signal replicator) replicates the input signal and generates a multichannel sound signal, whereas a gain value adjusting unit 30 (e.g., gain value adjuster) applies a predetermined gain value to the sound signal of each channel, of the multichannel sound signal, and outputs the sound signals.

An HRTF, which is included in the HRFT filter 10 and is applied to the input signal, may be a generalized HRTF indicating information regarding paths from an actual speaker to the ears of an audience. Therefore, a related art method of localizing a multichannel sound signal does not consider an HRTF that varies based on changes of locations of the ears of an audience or a change of an audience. As a result, the sense of elevation of an audience is deteriorated.

Figure 2:
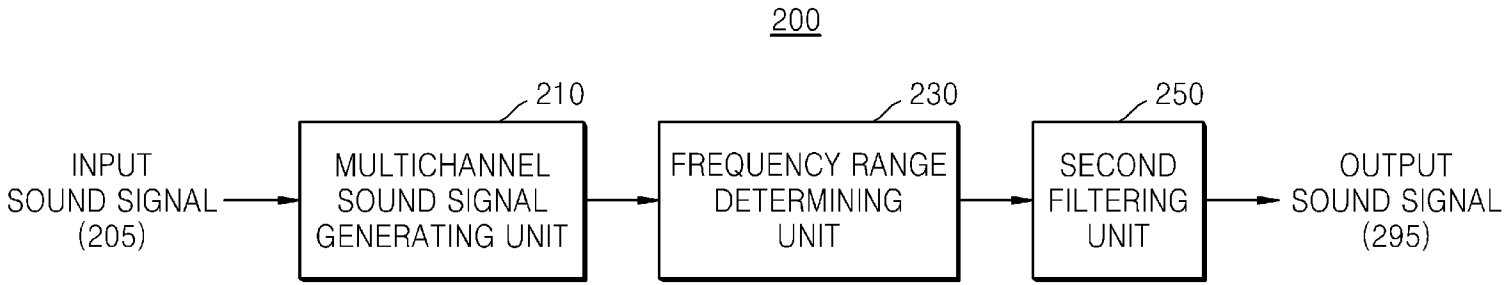
FIG. 2 is a block diagram showing a configuration of a multichannel sound signal localizing apparatus according to an exemplary embodiment.

FIG. 2 is a block diagram showing a configuration of a multichannel sound signal localizing apparatus 200 according to an exemplary embodiment.

Referring to FIG. 2, the multichannel sound signal localizing apparatus 200 shown in FIG. 2 may include a multichannel sound signal generating unit 210 (e.g., multichannel sound signal generator or multichannel sound signal obtainer), a frequency range determining unit 230 (e.g., frequency range determiner), and a second filtering unit 250 (e.g., second filterer). The multichannel sound signal generating unit 210, the frequency range determining unit 230, and the second filtering unit 250 may be embodied as at least one microprocessor. While not limited thereto, the multichannel sound signal localizing apparatus 200 according to one or more exemplary embodiments may be applied in a speaker (e.g., a sound bar, a channel speaker, a multichannel speaker, etc.) or an audio processing device (e.g., an audio receiver, an audio/video receiver, a set-top box, a television, a computer, a workstation, a tablet device, a portable device, a media storage, a media streaming device, etc.).

An input sound signal 205 is input to the multichannel sound signal generating unit 210. The input sound signal 205 may include a mono sound signal and a multichannel sound signal. The input sound signal 205 may be a signal stored in a memory (e.g., a volatile storage or a non-volatile storage) or a signal transmitted from an external device (an audio receiver, an audio/video receiver, a set-top box, a television, a computer, a workstation, a tablet device, a portable device, a media storage, a media streaming device, etc.).

The multichannel sound signal generating unit 210 may generate (e.g., obtain) a multichannel sound signal to which sense of elevation is applied by applying, to the input sound signal 205, a first filter corresponding to a predetermined elevation. In detail, the first filter may include an HRFT filter.

The HRTF includes information regarding paths from a spatial location of a sound source to both ears of an audience, that is, frequency transmission characteristics. The HRTF enables an audience to recognize stereoscopic sounds by using not only simple path differences, such as interaural level difference (ILD) and interaural time difference (ITD) between signals received by both ears, but also a phenomenon that characteristics of a complicated path, such as diffraction at head surface and reflection by earflap, is changed based on directions in which sound propagates. In each of the directions in a space, HRTF has unique characteristics. Therefore, stereoscopic sounds may be generated by using the HRTF.

Equation 1 below is an example of the first filter applied to the input sound signal 205 by the multichannel sound signal generating unit 210:

$$\text{Second HRTF}/\text{First HRTF} \qquad \text{[Equation 1]}$$

Figure 4:
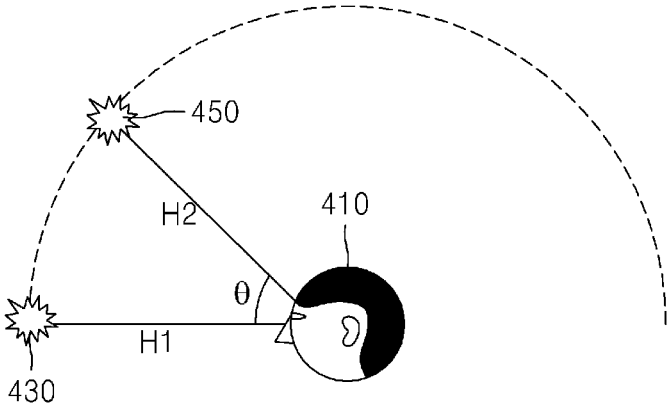
FIG. 4 is a diagram for describing a first filter in a multichannel sound signal localizing apparatus, according to an exemplary embodiment.

FIG. 4 is a diagram for describing a first filter in a multichannel sound signal localizing apparatus 200, according to an exemplary embodiment. In the present exemplary embodiment, a second HRTF includes an HRTF H2 which indicates information regarding paths from the spatial location of a virtual speaker 450 located at a predetermined elevation θ to the ears of an audience 410, whereas a first HRTF includes an HRTF H1 which indicates information regarding paths from the spatial location of an actual speaker 430 to the ears of the audience 410. Both the first HRTF and the second HRTF correspond to transfer functions in the frequency domain, and a convolution calculation for converting Equation 1 to the time domain may be performed. The virtual speaker 450 refers to a virtual speaker that is recognized as an unreal or non-physical speaker outputting sound signals to which sense of elevation is applied.

Since an output sound signal 295 heard by the audience 410 is output by the actual speaker 430, to make the audience 410 sense that the output sound signal 295 is output by the virtual speaker 450, the second HRTF corresponding to a predetermined elevation θ is divided by the first HRTF corresponding to a horizontal surface (or elevation of the actual speaker 430).

An optimal HRTF corresponding to the predetermined elevation θ may vary from person to person. Therefore, after calculating an HRTF for some people in a group having similar characteristics (e.g., physical characteristics such as age and elevation or preference characteristics such as preferred frequency bands and preferred genre of music), a representative value (e.g., an average value) may be determined as the HRTF to be applied to all people in the group. In other words, the second HRTF and the first HRTF in Equation 1 are generalized HRTFs corresponding to a predetermined elevation.

The multichannel sound signal generating unit 210 may select a suitable second HRTF based on a location at which a virtual sound source is to be localized (e.g., an elevation angle). The multichannel sound signal generating unit 210 may select a second HRTF corresponding to a virtual sound source by using mapping information between the location of the virtual sound source and the HRTF. Information regarding the location of the virtual sound source may be received via a (software or hardware) module, such as an application, or may be input by a user.

The frequency range determining unit 230 determines at least one frequency range of a dynamic cue according to a change of an HRTF indicating information regarding paths from the spatial location of an actual speaker to the ears of an audience.

As described above, the first HRTF and the second HRTF included in the first filter are generalized HRTFs. Therefore, when locations of the ears of an audience change as the audience moves its head or the audience moves, information regarding paths from the spatial location of the actual speaker to the ears of the audience is also changed. As a result, it may be difficult for the audience to receive a sense of elevation from the output sound signal 295 due to the dynamic cue based on factors including the change of the locations of the ears of the audience. The dynamic cue refers to the basis for receiving a sense of elevation of the output sound signal 295 (e.g., spectrum peaks and notches of sound pressure reaching the eardrums via which an audience recognizes sense of elevation). Therefore, if the basis is changed, the audience is unable to receive the sense of elevation of the output sound signal 295.

Figure 5A:
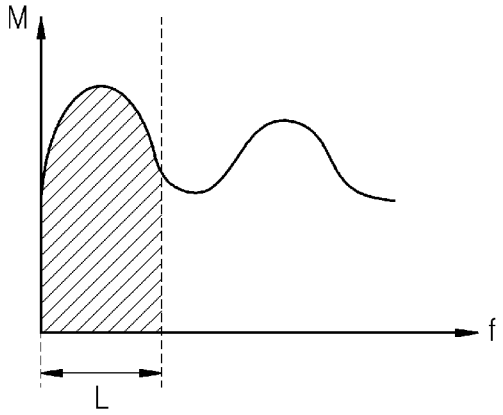
FIGS. 5A and 5B are diagrams for describing frequency range of a dynamic cue.
Figure 5B:
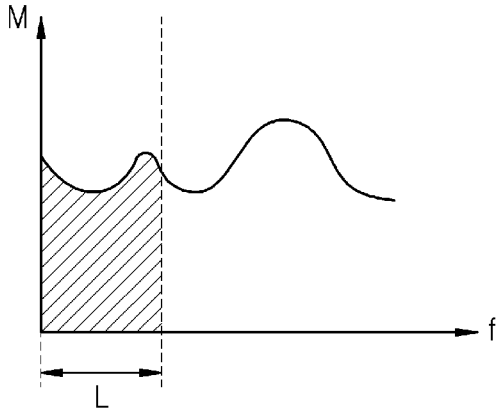

FIGS. 5A and 5B are diagrams for describing a frequency range of a dynamic cue.

FIG. 5A is a graph showing a magnitude M of a generalized first HRTF, which indicates information regarding paths from the spatial location of an actual speaker to the ears of an audience, in the frequency f domain, whereas FIG. 5B is a graph showing a magnitude M of a changed HRTF, which indicates information regarding paths from the spatial location of an actual speaker to the ears of an audience and is changed due to changes of the locations of the ears of the audience, in the frequency f domain.

Referring to FIGS. 5A and 5B, in the HRTF in the frequency domain, the magnitude M of an HRTF signal in the L section is changed due to factors including changes of the locations of the ears of the audience. In other words, the audience may be unable to receive a sense of elevation of the output sound signal 295 due to the change of the HRTF in the L section.

The L section may be determined in any of various manners. For example, the L section may be determined by comparing an HRTF at a first elevation to HRTFs at second elevations that are very close to the first elevation. Alternatively, the L section may be determined by comparing the HRTF at the first elevation to an HRTF corresponding to locations of the ears of an audience.

Referring back to FIG. 2, the second filtering unit 250 may apply a second filter to a sound signal of at least one channel from among a multichannel sound signal to which the first filter is applied. The multichannel sound signal localizing apparatus 200 may further include an output unit (e.g., a speaker, a communication interface, etc.) which outputs a multichannel sound signal to which the second filter is applied.

In a case where a multichannel sound signal to which the second filter is applied is output, a sound signal, corresponding to a frequency range of a dynamic cue, of at least one channel in the multichannel sound signal to which the second filter is applied, may be changed to remove or reduce the dynamic cue. When a sound signal (i.e., a portion of a channel signal) corresponding to a frequency range of the dynamic cue (i.e., a portion of a channel signal corresponding to the frequency range of the dynamic cue) is changed in a multichannel sound signal to remove or reduce the dynamic cue, an audience may receive a realistic sense of elevation even if locations of the ears of the audience change.

For example, if frequency ranges of the dynamic cue are between 800 Hz and 1000 Hz and between 1500 Hz and 2000 Hz, when channel signals of the respective channels included in a multichannel sound signal are output by a speaker, sound signals corresponding to the frequency ranges between 800 Hz and 1000 Hz and between 1500 Hz and 2000 Hz from among the output channel signals may be changed by removing or reducing the dynamic cue.

The second filter may include at least one from among a phase inverse filter for inversing a phase of sound signals included in the frequency ranges of the dynamic cue, an amplitude control filter for reducing amplitudes of sound signals included in the frequency ranges of the dynamic cue, and a delay filter for delaying the sound signals included in the frequency ranges of the dynamic cue.

If the second filter is a phase inverse filter and the multichannel sound signal is a stereo sound signal, the second filtering unit 250 may inverse the phase of sound signals in a left signal or a right signal in the stereo sound signal corresponding to the frequency ranges between 800 Hz and 1000 Hz and between 1500 Hz and 2000 Hz by applying the phase inverse filter to the left signal or the right signal. If the phase of sound signals in the left signal corresponding to the frequency ranges between 800 Hz and 1000 Hz and between 1500 Hz and 2000 Hz is inversed, when the left signal and the right signal are output by two-channel speakers, sound signals in the left signal and the right signal corresponding to the frequency ranges between 800 Hz and 1000 Hz and between 1500 Hz and 2000 Hz are offset at locations of the ears of an audience, and thus the dynamic cue is removed.

Furthermore, if the second filter is an amplitude control filter, the second filtering unit 250 may remove or reduce the dynamic cue by changing amplitudes of sound signals from among channel signals of the respective channels of a multichannel sound signal, the sound signals corresponding to the frequency ranges of the dynamic cue. For example, after sound signals in a left signal and a right signal in a stereo sound signal corresponding to the frequency ranges between 800 Hz and 1000 Hz and between 1500 Hz and 2000 Hz are divided or obtained according to frequency bands, amplitudes of the sound signals of the respective divided frequency bands may be adjusted to be different in the left signal and the right signal, and thus the dynamic cue may be reduced. Alternatively, the dynamic cue may be reduced by adjusting amplitudes of sound signals from among the channel signals of the respective channels in a multichannel sound signal corresponding to the frequency ranges between 800 Hz and 1000 Hz and between 1500 Hz and 2000 Hz to be close to zero.

Furthermore, if the second filter is a delay filter and the multichannel sound signal is a stereo sound signal, the second filtering unit 250 may apply the delay filter to a left signal or a right signal in the stereo sound signal. For example, the dynamic cue may be removed by delaying sound signals in the left signal corresponding to the frequency ranges between 800 Hz and 1000 Hz and between 1500 Hz and 2000 Hz, wherein the difference between the phase of the sound signals in the left signal and the phase of the sound signals in the right signal corresponding to the frequency ranges between 800 Hz and 1000 Hz and between 1500 Hz and 2000 Hz is 180°.

If a multichannel sound signal includes signals of two or more channels (e.g., 5.1 channels or 7.1 channels), dynamic cue may be removed or reduced by using at least one filter from among a phase inverse filter, an amplitude control filter, and a delay filter. Any of various methods for removing or reducing dynamic cue may be employed.

Figure 3:
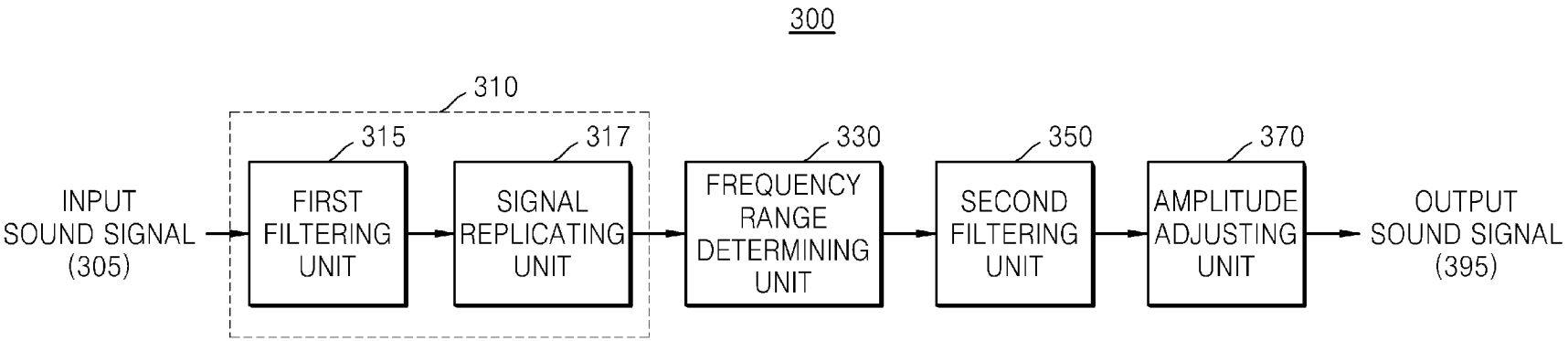
FIG. 3 is a block diagram showing a configuration of a multichannel sound signal localizing apparatus according to another exemplary embodiment.

FIG. 3 is a block diagram showing a configuration of a multichannel sound signal localizing apparatus 300 according to another exemplary embodiment.

Referring to FIG. 3, the multichannel sound signal localizing apparatus 300 shown in FIG. 3 may include a multichannel sound signal generating unit 310 (e.g., multichannel sound signal generator or multichannel sound signal obtainer), a frequency range determining unit 330 (e.g., frequency range determiner), a second filtering unit 350 (e.g., second filterer), and an amplitude adjusting unit 370 (e.g., amplitude adjuster). Since the frequency range determining unit 330 and the second filtering unit 350 are described above with reference to FIG. 2, detailed descriptions thereof are omitted herein. While not limited thereto, the multichannel sound signal localizing apparatus 300 according to one or more exemplary embodiments may be applied in a speaker (e.g., a sound bar, a channel speaker, a multi-channel speaker, etc.) or an audio processing device (e.g., an audio receiver, an audio/video receiver, a set-top box, a television, a computer, a workstation, a tablet device, a portable device, a media storage, a media streaming device, etc.).

The multichannel sound signal generating unit 310 may include a first filtering unit 315 and a signal replicating unit 317. The first filtering unit 315 applies a first filter to an input sound signal 305. In one or more exemplary embodiments, the first filtering unit 315 may also apply the first filter to the signal replicating unit 317. The first filter may include an HRTF filter. The signal replicating unit 317 generates (e.g., obtains) a multichannel sound signal by replicating the input sound signal 305 to which the first filter is applied. Although FIG. 3 shows that the first filtering unit 315 is arranged in front of the signal replicating unit 317, the first filtering unit 315 may be arranged after the signal replicating unit 317, and the first filter of the first filtering unit 315 may be applied to the multichannel sound signal generated by the signal replicating unit 317.

If the input sound signal 305 is a mono signal, the signal replicating unit 317 may generate a multichannel sound signal, such as a stereo sound signal, a 5.1 channel sound signal, and a 7.1 channel sound signal, by replicating the mono sound signal.

The amplitude adjusting unit 370 adjusts amplitudes of sound signals of the respective channels of the multichannel sound signal, such that a virtual speaker is located at a predetermined position on a horizontal surface including the virtual speaker located at a predetermined elevation. To localize a multichannel sound signal, which is localized to a predetermined elevation, in a predetermined direction on the horizontal surface at the predetermined elevation, the multichannel sound signal may be localized on the horizontal surface by adjusting amplitudes of sound signals of the respective channels by applying suitable gain values to the sound signals of the respective channels. As a result, an audience may receive not only a sense of elevation, but also a directional impression from an output sound signal 395 output by a speaker.

Figure 6:
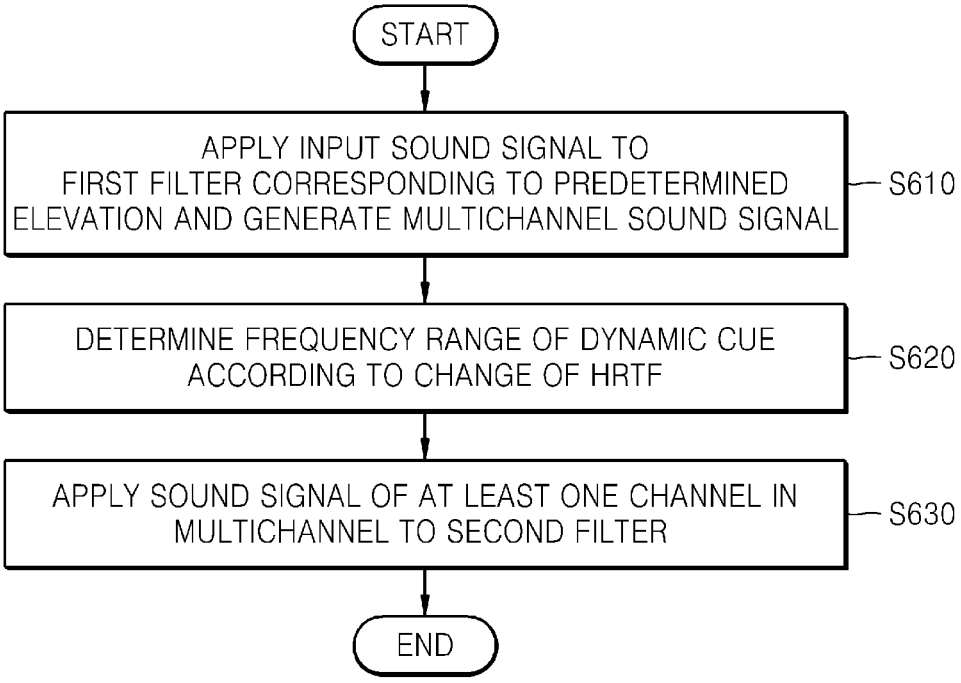
FIG. 6 is a flowchart showing a method of localizing a multichannel sound signal, according to an exemplary embodiment.

FIG. 6 is a flowchart showing a method of localizing a multichannel sound signal, according to an exemplary embodiment. Referring to FIG. 6, the method of localizing the multichannel sound signal includes operations that are performed by the multichannel sound signal localizing apparatus 200 shown in FIG. 2. Therefore, even though omitted below, the descriptions of the multichannel sound signal localizing apparatus 200 shown in FIG. 2 above may also be applied to the method of localizing a multichannel sound signal shown in FIG. 6.

In operation S610, the multichannel sound signal localizing apparatus 200 generates a multichannel sound signal to which sense of elevation is applied by applying a first filter corresponding to a predetermined elevation to an input sound signal. The input sound signal may include a mono sound signal and a stereo sound signal, and the multichannel sound signal may have more channels than the input sound signal.

In operation S620, the multichannel sound signal localizing apparatus 200 determines a frequency range of a dynamic cue according to change of an HRTF indicating information regarding paths from the spatial location of an actual speaker to the ears of an audience. Due to the dynamic cue according to the change of the HRTF, the sense of elevation received by an audience from a sound signal output by the speaker may be deteriorated.

In operation S630, the multichannel sound signal localizing apparatus 200 applies a second filter to a sound signal of at least one channel from among the multichannel sound signal. When the multichannel sound signal to which the second filter is applied is output by a speaker, a signal in the multichannel sound signal to which the second filter is applied corresponding to the frequency range of the dynamic cue is changed to remove or reduce the dynamic cue. In other words, the dynamic cue of the multichannel sound signal may be removed or reduced by the second filter, and thus a realistic sense of elevation may be provided to an audience.

One or more exemplary embodiments can be written as computer programs and can be implemented in general-use digital computers that execute the programs using a computer readable recording medium.

Examples of the computer readable recording medium include magnetic storage media (e.g., ROM, floppy disks, hard disks, etc.), optical recording media (e.g., CD-ROMs, or DVDs), etc. Moreover, one or more of the above-described elements can include a processor or microprocessor executing a computer program stored in a computer-readable medium.

While exemplary embodiments have been particularly shown and described above, it will be understood by those of ordinary skill in the art that various changes in form and details may be made therein without departing from the spirit and scope of the present invention as defined by the following claims.

What is claimed is:

1. An immersive three-dimensional (3D) sound reproducing method comprising:

receiving input channel audio signals including at least one height input channel signal and an input channel configuration;

obtaining gains based on the input channel configuration and an output channel configuration;

obtaining a first head-related transfer function (HRTF) based on the input channel configuration, to provide a sense of elevation using the output channel configuration indicating a plurality of output speakers located on a horizontal plane;

obtaining a second HRTF used according to an input channel audio signal at a predetermined position, the input channel audio signal being output through at least two speakers at positions different from the predetermined position, based on the input channel configuration, the output channel configuration, and a frequency range of dynamic cue;

obtaining a HRTF filter by dividing the second HRTF by the first HRTF; and elevation rendering the input channel audio signals based on the gains, the HRTF filter, to provide the sense of elevation using the output channel configuration, wherein the second HRTF includes filter coefficients for a plurality of frequency bands dividing the frequency range, wherein each of the at least one height input channel signal is outputted to at least two of output channel audio signals via at least two output speakers located on the horizontal plane, and wherein the frequency range of the dynamic cue is determined according to a change of the second head related transfer function.

2. The method of claim 1, wherein the dynamic cue represents speaker-to-listener orientation.

3. The method of claim 1, wherein the second HRTF is determined based on spatial locations of a output channel signal and a input channel signal located at a predetermined elevation.

4. A non-transitory computer readable recording medium having embodied thereon a computer program, which when executed by a processor, performs the method of claim 1.

5. The method of claim 1, wherein the second HRTF is determined based on spatial locations of an output channel signal and an input channel signal located on the horizontal plane.

6. The method of claim 1, wherein the first HRTF indicates information regarding paths from a spatial location of the plurality of output speakers to ears of an audience, and the second HRTF indicates information regarding paths from a spatial location of a virtual speaker located at a predetermined elevation to ears of the audience.

7. An immersive three-dimensional (3D) sound reproducing apparatus comprising:

receiver configured to receive input channel audio signals including at least one height input channel signal and an input channel configuration;

elevation renderer configured to obtain gains based on the input channel configuration and an output channel configuration, obtain a first head-related transfer function (HRTF) based on the input channel configuration, to provide a sense of elevation using the output channel configuration indicating a plurality of output speakers located on a horizontal plane, obtain a second HRTF used according to an input channel audio signal at a predetermined position, the input channel audio signal being output through at least two speakers at positions different from the predetermined position, based on the input channel configuration, the output channel configuration, and a frequency range of dynamic cue, obtain a HRTF filter by dividing the second HRTF by the first HRTF, and render the input channel audio signals based on the gains, and the HRTF filter, to provide the sense of elevation using the output channel configuration, wherein the second HRTF includes filter coefficients for a plurality of frequency bands dividing the frequency range, wherein each of the at least one height input channel signal is outputted to at least two of output channel audio signals via at least two output speakers located on the horizontal plan, and wherein the frequency range of the dynamic cue is determined according to a change of the second head related transfer function.

8. The apparatus of claim 7, wherein the dynamic cue represents speaker-to-listener orientation.

9. The apparatus of claim 7, wherein the second HRTF is determined based on spatial locations of a output channel signal and a input channel signal located on a same plane.

10. The apparatus of claim 9, wherein the same plane is the horizontal plane.

11. The apparatus of claim 7, wherein the first HRTF indicates information regarding paths from a spatial location of the plurality of output speakers to ears of an audience, and the second HRTF indicates information regarding paths from a spatial location of a virtual speaker located at a predetermined elevation to ears of the audience.

* * * * *